United States Patent [19]

Bernath

[11] 4,286,540

[45] Sep. 1, 1981

[54] APPARATUS FOR STRENGTHENING POROUS PLATES BY IMPREGNATION

[75] Inventor: Oskar Bernath, Umiken, Switzerland

[73] Assignee: Georg Fischer Brugg-Oehler AG, Switzerland

[21] Appl. No.: 20,246

[22] Filed: Mar. 13, 1979

[30] Foreign Application Priority Data

Apr. 4, 1978 [CH] Switzerland ..... 3595/78

[51] Int. Cl.[3] ..... C23C 13/08

[52] U.S. Cl. ..... 118/50; 118/50.1; 118/425; 118/694

[58] Field of Search ..... 118/50, 50.1, 425, 694; 414/626; 427/284

[56] References Cited

U.S. PATENT DOCUMENTS

| | | | |
|---|---|---|---|
| 2,372,755 | 4/1945 | Abell | 118/425 |
| 2,917,195 | 12/1959 | Hanson | 414/626 |
| 3,233,579 | 2/1966 | Arvidsson | 118/50 |
| 3,747,784 | 7/1973 | Dean | 414/626 |
| 4,129,091 | 12/1978 | France et al. | 118/50 |
| 4,144,836 | 3/1979 | Bernath | 118/50 |

FOREIGN PATENT DOCUMENTS

| | | | |
|---|---|---|---|
| 2715237 | 10/1977 | Fed. Rep. of Germany | 118/50 |
| 577378 | 7/1976 | Switzerland . | |
| 515534 | 5/1976 | U.S.S.R. | 118/425 |

*Primary Examiner*—Ronald H. Smith
*Assistant Examiner*—S. L. Childs
*Attorney, Agent, or Firm*—Roylance, Abrams, Berdo & Farley

[57] ABSTRACT

Plates made of porous material are strengthened by impregnation with a hardening fluid. The plates are stacked, subjected to vacuum in a chamber and immersed in the treating fluid, and pressure is then exerted on the fluid. The apparatus includes a chamber which contains a body of the fluid and which can be made airtight by applying a cover. The cover carries a support frame which carries a stack of plates, the cover having a hoisting device to lower the frame and stack into the fluid. A vacuum source and pressure source are connected to the container through a control valve.

11 Claims, 2 Drawing Figures

APPARATUS FOR STRENGTHENING POROUS PLATES BY IMPREGNATION

Figure 1:
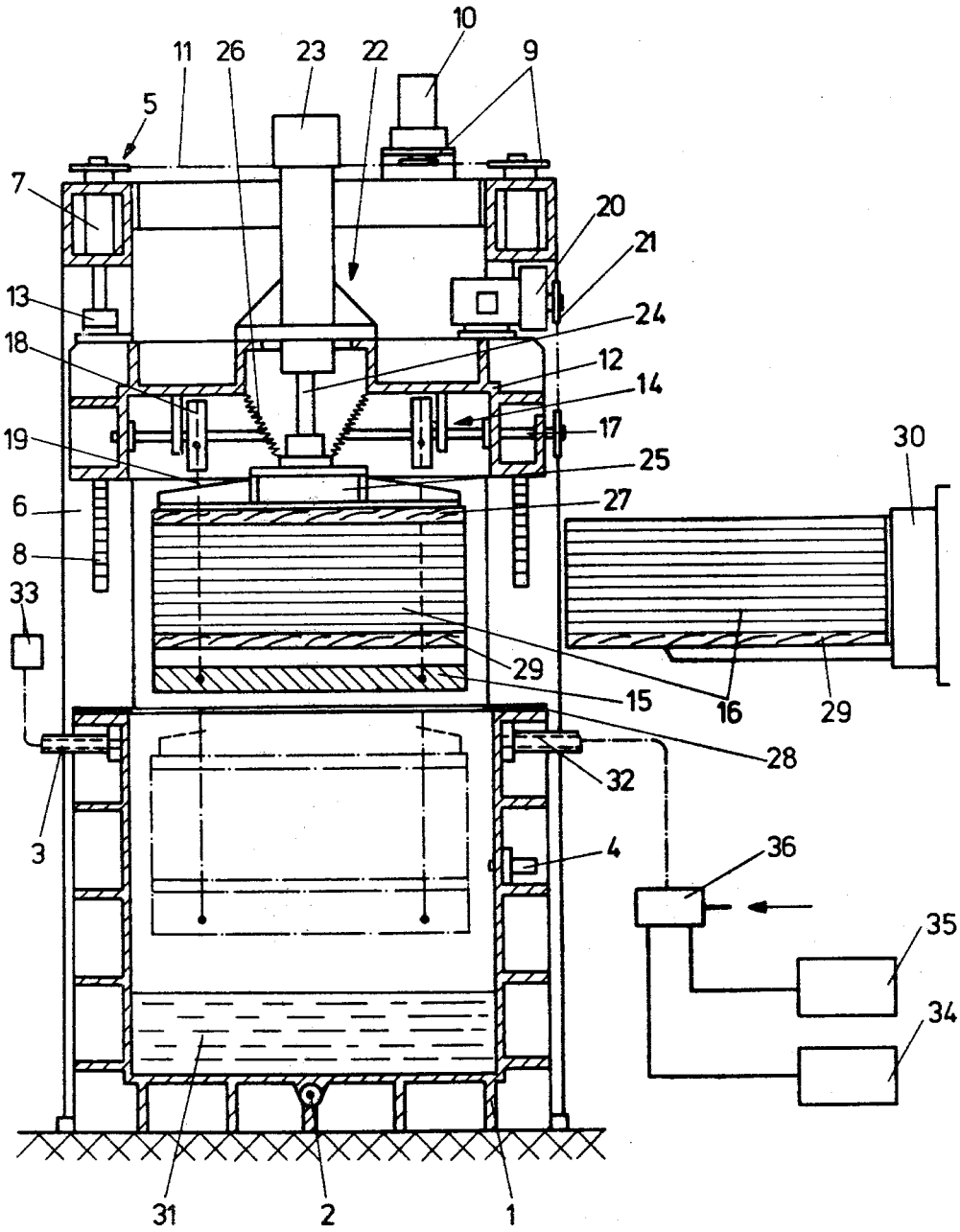

This invention relates to a method and apparatus for strengthening the edge areas of plates made of a porous material by impregnation with a hardening and strengthening fluid, using a vacuum.

BACKGROUND OF THE INVENTION

A method of the general category to which the invention relates is shown in Swiss Pat. No. 577,378, in which a plate, both major surfaces of which are covered, is immersed in a strengthening fluid and in which the air contained in the plate is removed from at least one of the major surfaces of the plate. The process thus shown makes it possible to treat only one plate at a time, and it is particularly suited only for small numbers of plates or individual plates, working by hand.

German Offenlegungsschriften No. 2,715,237 shows apparatus for a similar proces and discloses means by which a more automatic method of operation is made possible.

With these devices, only one plate can be treated at a time since a uniform vacuum is not ensured when several plates are lying one on top of the other, and the air is removed from one plate surface, and this leads to uneven depth of penetration of the strengthening fluid.

Thus, in order to multiply the efficiency of such techniques, it is necessary to develop a new process.

BRIEF DESCRIPTION OF THE INVENTION

An object of the present invention is to provide a method and apparatus by means of which the edge areas of a number of plates made of a porous material can be simultaneously strengthened and solidified in order to achieve economic output in series production.

Briefly described, the invention includes a method of strengthening and solidifying the edge areas of plates made of a porous material by impregnating the edge areas with a hardening fluid comprising the steps of forming a stack of a plurality of plates to be treated, pressing the stack of plates together with the top and bottom surfaces of the stack covered, subjecting the stack of plates to a vacuum in a closed chamber, immersing the stack in a body of hardening fluid while maintaining the vacuum until the stack is completely surrounded by the fluid, and subjecting the body of fluid to pressure while the stack is immersed therein.

In the above method, the body of fluid can be subjected to pressure corresponding to atmospheric pressure, or, in some cases, it can be subjected to pressure greater than atmospheric.

The invention further contemplates an apparatus for impregnating the edge areas of plates made of a porous material with a hardening fluid for strengthening and solidifying the edge areas thereof comprising the combination of a container for holding a body of hardening fluid, a cover for the container, the cover being liftable and lowerable away from and toward the container between an open position and a closed position, means for lifting and lowering the cover, means for forming an airtight seal between the cover and container when closed, a support frame attached to the cover for supporting from below a stack of plates to be treated, means for lifting and lowering the support frame relative to said cover, means carried by the cover for applying pressure to the top of the stack of plates, and means coupled to the container for varying the pressure therein from a pressure substantially below atmospheric pressure to a pressure at least as great as atmospheric pressure.

Figure 2:
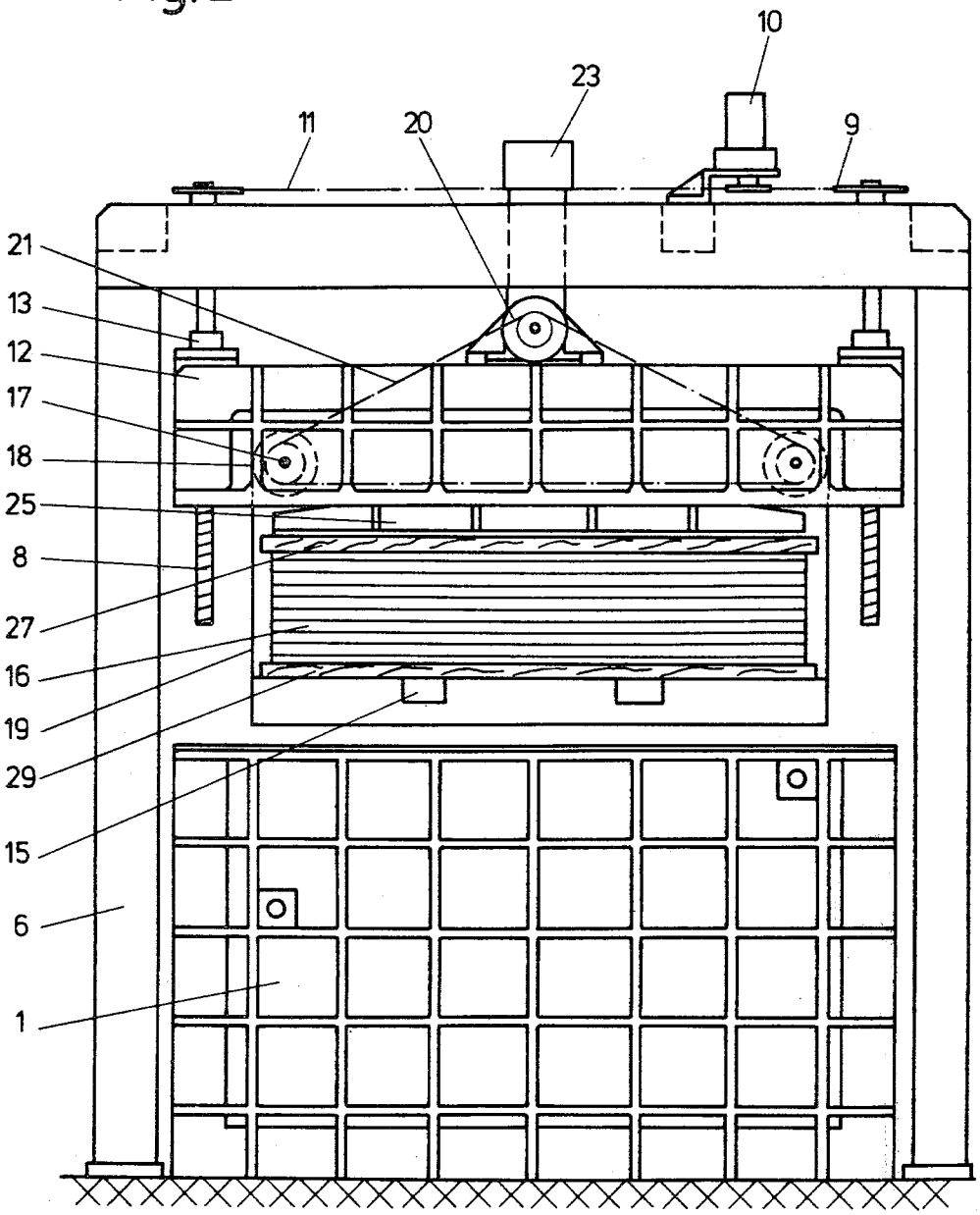

In order that the manner in which the foregoing and other objects are attained in accordance with the invention can be understood in detail, particularly advantageous embodiments thereof will be described with reference to the accompanying drawings, which form a part of this specification, and wherein:

FIG. 1 is a front elevation, in partial section, of an apparatus in accordance with the invention; and FIG. 2 is a side elevation, in partial section, of the apparatus of FIG. 1.

As shown in FIGS. 1 and 2, the apparatus includes a container 1 which contains a body of a strengthening fluid 31, preferably a resin. An outlet 2, which can be closed, is provided for the purpose of cleaning the container 1. Inflow of the fluid takes place through a supply line 3 through which fluid is fed by gravity from a supply tank located in an elevated position. A valve 33 is located in the supply line 3 for the purpose of opening and closing the supply line, the valve preferably being a magnetically operated valve operatively associated with a monitor or indicator 4 which monitors the level of the fluid in the chamber. The interior volume of the container is connected through a line 32 and a control valve 36 to a vacuum source 34, to a pressure source 35, or it can be vented to the atmosphere. Valve 36 thus is a three-position valve which permits the interior of the container to be selectively connected to any of these three pressure sources.

A cover 12 is suspended on a stand 6 so as to be liftable and lowerable by means of a lifting device indicated generally at 5. The lifting device 5 includes four threaded spindles 8 which are attached to the stand 6 by means of bushings 7, the spindles being rotatably driven by a geared motor 10 through sprocket wheels 9 and a drive chain 11 such that rotation of the motor causes concurrent rotation of the spindles. The spindles 8 threadedly engage spindle nuts 13 which are mounted in cover 12. By lowering the cover 12 onto container 1, which is provided with a gasket or seal 28, the interior of the container is hermetically sealed with respect to the ambient atmosphere, producing an airtight chamber. A support frame 15 within the chamber is suspended by a tackle device 14, frame 15 being for the purpose of supporting a stack of plates 16 which are to be treated, the frame being suspended from cover 12. Tackle device 14 includes two rotatable shafts 17 rotatably mounted in cover 12, each of the shafts having two hoisting drums 18 to which cables are attached, the other ends of the cables being fixedly attached to support frame 15. A geared motor 20 is coupled to shafts 17 through a drive chain 21. Thus, upon operation of motor 20, shafts 17 and drums 18 are rotated, permitting cables 19 to be wound up or unwound from the drums, thereby lifting or lowering the support frame.

A loading device 30, which is not described in any greater detail, is used to charge the apparatus with a stack of plates 16 which are to be treated. The plates are lying one on top of another and are on a lower cover plate 29 and, in this arrangement, are loaded onto support frame 15. A pressure device indicated generally at 22 is carried by the cover 12, the pressure device constituting means for applying pressure to the top of the stack of plates. Pressure device 22 includes a piston and cylinder assembly 23, a press die 25 fastened to the piston shaft 24, and an upper cover plate 27. The upper cover plate is lightly and removably attached to the press die 25 and, like the lower cover plate 29, can be adjusted to the size of the plates 16 to be treated. A flexible covering 26 is located between the press die 25 and cover 12 to protect piston shaft 24.

The operation of the device thus described is as follows. In the loading position shown in FIG. 1, the cover 12 and the support frame 15 are in their uppermost positions. When in that position, a stack of plates is laid on the support frame 15 by means of the loading device 30 with the plates 16 to be treated lying on the lower cover plate 29. The stack of plates, which is simultaneously covered by the upper cover plate 27 and press die 25, is pressed together by the action of the pressure cylinder 23 supplied with a pressure medium, either pneumatic or hydraulic.

The cover 12 is then lowered by driving spindles 8 such that the support frame 15, along with the plates 16 to be treated, arrives at the position indicated by dash-dot lines in FIG. 1, and the container is closed to an airtight condition at this same time. Valve 36 is then actuated to connect the interior chamber to the source of vacuum 34, reducing the pressure in the chamber to a value somewhat below atmospheric pressure, thereby removing the air from the porous plates 16 by suction to a considerable extent, thereby facilitating subsequent penetration of the strengthening fluid 31. After a period of time which can be adjusted, the support frame 15 is lowered into the strengthening fluid by means of the cables 19 while the vacuum is maintained by energizing the geared engine 20, the entire stack of plates thus being flooded as they are immersed in the body of fluid and displace a significant portion of the fluid body so that the level thereof rises. At the same time, pressure is supplied to piston and cylinder assembly 23 causing piston shaft 24 to extend as the stack is lowered, thereby continuing to apply pressure to the stack of plates. As will be observed, the stroke of the piston shaft 24 is selected to be at least as great as the total distance traveled of the stack from cover 12. After the stack of plates is completely immersed in and surrounded by the fluid, the vacuum is broken by switching the switch valve to the vent position and connecting the interior of the chamber to the atmosphere. Thereafter, valve 36 can be actuated to its third position in which the interior of the chamber is connected to the source of pressure 35, permitting the pressure within the chamber to be elevated above atmospheric pressure to a desired degree. This pressure which acts on the surface of the strengthening fluid 31 pushes it into the edge part of the evacuated plates 16 within a period of time which can be selected by means of the falling level of the fluid resulting from the penetration. The falling level of the fluid is detected by monitor 4 which causes the valve 33 to open and permits the fluid 31 to be replenished through conduit 3. After the interior of the container is vented to the atmosphere through line 32, the support frame can be raised again by means of the tackle assembly including cables 19 and cover 13 can be elevated to its upper position again by lifting device 5. After an interval to permit dripping of excess liquid from the plate and support assembly, the press die 25 is raised with the upper cover plate 27 by reversing the action of piston and cylinder assembly 23. The plates 16 whose edge areas have been treated with the strengthening fluid can now be removed using the loading and unloading device 30, readying the apparatus for another work cycle.

If individual edge portions of plates are not to be strengthened, penetration of the fluid can be prevented at those places by coverings applied thereto in advance of the above described process.

The method of the invention makes it possible to strengthen the edges of a number of plates simultaneously with the use of vacuum and pressure, making rapid penetration of the strengthening fluid possible and thus leading to short work cycles. The device with the strengthening fluid stationary in the container ensures simple cleaning and a reliable method of operation since no conveying or transporting devices such as pumps, for example, can be clogged by the hardening resins used as strengthening fluids. The work process can be carried on automatically and the device makes a method of operation possible which is not harmful to the environment.

(*) The term "boards made of porous materials" as used here comprises chipboards, pressboards and composition boards, but pertains in particular to particle boards made of wood or bagasse.

While one advantageous embodiment has been chosen to illustrate the invention, it will be understood by those skilled in the art that various changes and modifications can be made therein without departing from the scope of the invention as defined in the appended claims.

The hardening or solidifying fluid can be either polyurethane or urea resin, e.g. "Kaurit" supplied by the BASF Company of Ludwigshafen, Western Germany.

Vacuum or pressure can be selected within a broad range, so that the vacuum varies from −0,87 to 0,0 bar and the pressure up to 1,3 bar above the atmospheric pressure.

Depending on the desired depth of the impregnation, vacuum and pressure determine the duration of the interference for a given material.

The following values have proved to be suitable for a depth of impregnation of approx. 40 mm.

| Board material | Hardening fluid | Vacuum (bar) | Pressure above atmospheric pressure (bar) |
|---|---|---|---|
| Wooden chipboard 600 kg/m3 | Polyurethane | −0,72 | 0,9 |
| Wooden chipboard 600 kg/m3 | Urea resin (Kaurit, BASF) | −0,87 | 1,2 |
| Bagasse board 520 kg/m3 | Polyurethane | −0,72 | 0,8 |
| Bagasse board 520 kg/m3 | Urea resin (Kaurit, BASF) | −0,87 | 1,3 |

What is claimed is:

1. An apparatus for impregnating the edge areas of plates made of a porous material with a hardening fluid for strengthening and solidifying the edge areas comprising the combination of a container for holding a body of hardening fluid;

a cover for said container, said cover being liftable and lowerable away from and toward said container between an open position and a closed position;

means for lifting and lowering said cover;

means for forming an airtight seal between said cover and container when closed;

a support frame attached to said cover for supporting from below a stack of plates to be treated;

means for lifting and lowering said support frame with a stack of plates to be treated supported therein relative to said cover between a first position above the hardening fluid and a second position submerged in the hardening fluid while said cover is sealed and to said container;

means carried by said cover for applying pressure to the top of said stack of plates; and means coupled to said container for varying the pressure therein from a pressure substantially below atmospheric pressure to a presure at least as great as atmospheric pressure.

2. An apparatus according to claim 1 wherein said means for lifting and lowering said cover includes a supporting frame;

a plurality of threaded spindles rotatably mounted in said supporting frame; and a plurality of spindle nuts carried by said cover and threadedly engaging said spindles.

3. An apparatus according to claim 2 wherein four threaded spindles are provided, said means for lifting further comprising a geared drive motor; and a drive chain coupled to said motor and said spindles for rotating said spindle upon rotation of said motor.

4. An apparatus according to claim 1 wherein said means for lifting and lowering said support frame includes a tackle assembly coupled to said cover.

5. An apparatus according to claim 10 wherein said tackle assembly comprises first and second rotatable shafts;

a plurality of hoisting drums mounted on said shafts for rotation therewith; and cables fixedly attached to said support frame and said drums, said cables being coilable on said drums as said shafts are rotated.

6. An apparatus according to claim 5 wherein said tackle assembly further comprises drive means including a geared motor and a drive chain coupling said motor to said shafts for rotating said shafts.

7. An apparatus according to claim 1 wherein said means for applying pressure to the top of said stack includes a piston and cylinder assembly having a stroke greater than the travel distance of said means for lifting and lowering said support frame.

8. An apparatus according to claim 7 wherein said means for applying pressure includes a replaceable cover plate for covering the top of said stack.

9. An apparatus according to claim 1 and further including a bottom cover plate on which said plates can be stacked before loading onto said support frame, said bottom cover plate being loadable onto said frame with said stack.

10. An apparatus according to claim 1 and further comprising a fluid level monitor mounted on said container;

a source of strengthening fluid coupled to said container; and valve means connected between said source and said container for controlling flow of fluid into said container, said valve means being responsive to a signal from said monitor to permit flow of fluid to said container when the level therein is below a predetermined point.

11. An apparatus according to claim 1 wherein said means for varying the pressure includes vacuum pump means for evacuating the interior of said chamber;

a source of gas under pressure;

conduit means for connecting said vacuum pump and said source of gas to said container; and valve means in said conduit means for selectively interconnecting the chamber interior with one of said vacuum pumps, said source of gas and the atmosphere.

* * * * *